US005799839A

United States Patent [19]

Moran et al.

[11] Patent Number: 5,799,839

[45] Date of Patent: Sep. 1, 1998

[54] DUAL SPOUT STOPPER

[75] Inventors: Jorge E. Moran, Nashville, Tenn.; Ariel Lijtenstein, Montevideo, Uruguay

[73] Assignee: Megatrade International, Inc., Nashville, Tenn.

[21] Appl. No.: 810,081

[22] Filed: Mar. 4, 1997

[51] Int. Cl.[6] ..... B67D 3/00

[52] U.S. Cl. ..... 222/484; 222/522; 222/543

[58] Field of Search ..... 222/484, 543, 222/482, 481.5, 481, 478, 479, 522, 523, 519, 521

[56] References Cited

U.S. PATENT DOCUMENTS

| | | | |
|---|---|---|---|
| 1,194,450 | 8/1916 | Wesel | 222/482 |
| 1,570,270 | 1/1926 | Miller | 222/543 X |
| 2,013,440 | 9/1935 | Gessler | 222/543 X |
| 3,067,916 | 12/1962 | Lerner | 222/484 X |
| 3,140,799 | 7/1964 | Mehr | 222/484 X |
| 3,317,093 | 5/1967 | Moran | 222/484 |
| 3,776,433 | 12/1973 | DeTreitas | 222/519 |
| 4,261,487 | 4/1981 | Seager | 222/520 |
| 4,919,309 | 4/1990 | Arona-Delonghi | 222/548 X |
| 4,930,688 | 6/1990 | Arona-Delonghi | 222/484 |
| 4,979,654 | 12/1990 | Nohren, Jr. | 222/482 |
| 5,190,193 | 3/1993 | Scudday | 222/543 X |
| 5,620,119 | 4/1997 | Bieze et al. | 222/484 X |

*Primary Examiner*—Kevin P. Shaver

*Attorney, Agent, or Firm*—Arent Fox Kintner Plotkin & Kahn, PLLC

[57] ABSTRACT

The present invention is directed to the exemplary embodiment of a fluid dispensing apparatus which is sealingly engaged with the discharge opening of a container. The present invention is structurally comprised of a cylindrical skirt, which is sealingly engageable with the discharge opening of the container and an internal tubular sleeve which is concentric with the cylindrical skirt and is integrally attached to a circular annular plate. The circular annular plate is, in turn, integrally attached perpendicular to the cylindrical skirt and a cylindrical shield. The cylindrical shield is concentric with the cylindrical skirt and is integrally attached to the circular annular plate, as well as the cylindrical skirt and extends upward perpendicular thereto. The present invention is also comprised of a manually actuatable cylindrical valve assembly comprising a telescoping dual spout assembly and an internal tubular sleeve in cooperative arrangement. The telescoping dual spout assembly is a component of the apparatus and moves axially and rotationally within said internal tubular sleeve to open and close the manually actuatable cylindrical valve. The telescoping dual spout assembly is comprised of two separate flow chambers integrally attached to a cylindrical valve chamber. A cover is attached to the manually telescoping dual spout assembly. A post is attached perpendicular to the cover and an annular gasket constructed of elastomeric material is affixed to the underside of the circular annular plate to enhance the sealing engagement of the apparatus.

8 Claims, 2 Drawing Sheets

DUAL SPOUT STOPPER

BACKGROUND OF THE INVENTION

The present invention relates to a dual spout stopper, which may be affixed in sealing relation to the neck of a container, such as a thermos or vacuum flask and which has the ability to dispense fluid in a controlled manner without the need for removal of the stopper itself. This dual spout stopper finds particular utility by providing the consumer with the ability to select two radially disposed spouts with different flow path diameters. This allows the consumer to regulate the stream or flow of a liquid when it is dispensed from the container. The present invention allows a consumer to choose, for example, a heavy stream for liquids stored at or below room temperature or a lighter stream for liquids, such as coffee or cocoa, which are often served while hot. This option also allows the user to regulate the rate and volume of flow to accommodate the size of the vessel into which the liquid is dispensed.

In addition, the present invention prevents the vacuum effect, which often occurs in rigid containers to which a stopper is affixed, by allowing air to enter the flow chamber which is not engaged in dispensing fluids, thereby allowing the fluid to flow freely from the other flow chamber. In the field of container stoppers and spouts, there also exists a need for a device which is inexpensive, efficiently manufactured, low-maintenance and easy to use. This need extends to a stopper and spout which, like the present invention, is easily sealable and will not allow ambient air to enter the container when closed, so as to prevent the warming or chilling of the liquid contained therein.

There currently exist a number of proposed stoppers which employ a single spout with which to dispense liquid from a container. For example, the bottle cap disclosed in U.S. Pat. No. 4,930,688, issued to Arona-Delonghi, is opened by rotating the cap in an upward movement, thus allowing the contained product to decant. The Arona-Delonghi device dispenses the product from a single orifice at the top of the cap. In order to properly dispense the product, the container must be tilted at an angle, which will vary in acuity with the viscosity of the liquid contained therein. That is, if the liquid is highly viscous, the container will have to be tilted at a greater angle, thus increasing the risk that more of the product will be dispensed than is desired. The flow rate of less viscous liquids may not easily be controlled either. The present invention solves this problem by providing elongated flow paths which allow the contained liquid to flow radially from the top of the container, thus requiring a lesser angle of tilt of the container vessel and greater control of flow rate.

U.S. Pat. No. 4,919,309, also issued to Arona-Delonghi, discloses the use of multiple exit orifices, primarily to permit the entry of air into the bottle to remedy the vacuum effect. However, the discussion of multiple orifices in the '309 patent does not include any teaching as to dual spouts of different flow chamber diameters, nor of utilizing elongated flow chambers to concentrate and control the flow of fluid during dispensing.

U.S. Pat. No. 3,776,433 issued to De Treitas discloses a dispensing closure for a container formed of a cylindrical skirt which sealingly attaches to the neck of a container, and a stopper which engages the skirt through cooperative threads. When the stopper is loosened by rotation, an annular space is created between the stopper and the inverse conical portion of the skirt, thus creating a flow path for the liquid to decant. Although this annular space allows for multidirectional flow, in practice the rate and pattern of the flow of the liquid from the container is not easily predicted or controlled, which may potentially cause spillage or splattering. The present invention solves this problem, since when the spout assembly is rotated upward away from the stopper, liquid may flow radially through either of two elongated flow channels, each of which are of a fixed diameter. This allows the user to direct the liquid and control its flow rate and volume more easily than is the case with the De Treitas device. U.S. Pat. No. 4,261,487 issued to Seager teaches a variation of the De Treitas device, which has the same inherent disadvantages.

SUMMARY OF THE INVENTION

It is therefore an object of the present invention to provide consumers with an inexpensive, efficiently manufactured, low maintenance dual spout stopper.

Another object of the present invention is to provide consumers with as stopper whose two spouts, wherein each spout has a flow chamber of a different diameter, which will allow consumers to select and control the rate and volume of fluid flow.

It is a further object of the invention to provide consumers with a stopper and dual spout assembly which is easy to use, in that the spout and stopper assemblies combine to form a simple valve assembly which is opened and closed by the raising and lowering of the dual spout assembly in relation to the stopper.

Still another object of the invention is to provide a stopper and dual spout assembly which will prevent the escape of heat in situations where hot fluids, such as coffee or cocoa, are to be contained and dispensed, or which will prevent the intrusion of comparatively warm ambient air, in situations where cold liquids are contained and dispensed.

An additional object of the invention is to provide a means for air to flow into the container during the dispensing of fluids, in order to prevent the vacuum effect, which often inhibits fluid flow.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purposes of the invention, as embodied and broadly described herein, the present invention is directed to a fluid dispensing apparatus of a container, having a discharge opening, comprising a cylindrical skirt, an internal tubular sleeve, a cylindrical shield, a telescoping dual spout assembly and a manually actuatable valve assembly. The cylindrical skirt is affixed in sealing engagement with the discharge opening of a container. The skirt may be affixed to a container through the use of screw threads integrally molded to its interior diameter and which cooperatively attach in sealing relation to threads mounted on the exterior diameter of the neck of a container. The seal is enhanced by the use of an annular gasket constructed of elastomeric material which is mounted on the underside of a circular annular plate, which is a component of on the stopper.

The internal tubular sleeve is concentric with the cylindrical skirt and is integrally attached perpendicular to the circular annular plate, which is in turn integrally attached perpendicular to the cylindrical skirt and cylindrical shield. The cylindrical shield is also concentric with the cylindrical skirt and is integrally attached to the circular annular plate and the cylindrical skirt and extends upward perpendicular thereto. The exterior diameter of the cylindrical skirt and the cylindrical shield are comprised of a plurality of ovular indentations of a shape and width which closely approximate those of human fingers, so as to augment ease of engagement of the cylindrical skirt with the neck of a container, as well as its removal.

The present invention also employs a telescoping dual spout assembly, which is a component of the apparatus of the present invention, and is comprised of two separate flow chambers integrally attached to a cylindrical valve chamber. The two flow chambers may be radially disposed 180 degrees apart from one another about the cylindrical valve chamber. The flow chambers may also be of differing shapes and diameters. The spouts are opened through the use of a manually actuatable cylindrical valve assembly which is comprised of the telescoping dual spout assembly and the internal tubular sleeve in cooperative arrangement, wherein the telescoping dual spout assembly moves axially and rotationally within the internal tubular sleeve to open and close the valve and allow fluid to decant. A cover is attached to the top of the manually telescoping dual spout assembly.

The dual spout stopper of the present invention also includes a post which is constructed of an elongated rod attached perpendicularly at one end to the cover and which extends axially therefrom. The rod extends below the internal tubular sleeve and terminates with a second rod integrally attached perpendicular thereto, to form a "T" shaped unit. A second embodiment of the post takes the form of a rod attached perpendicularly at one end to the cover and which extends axially therefrom through a stay and terminates with a plug integrally attached to the rod. The stay that is employed is affixed to the interior wall of the internal tubular sleeve and extends horizontally across the opening of the sleeve above the plug. The stay is further comprised of an eyelet disposed about its midpoint, whose diameter allows the rod to freely move axially therethrough and where the width of the plug in relation to that of the eyelet will not allow the plug to pass through the eyelet.

DETAILED DESCRIPTION OF THE INVENTION

Figure 1:
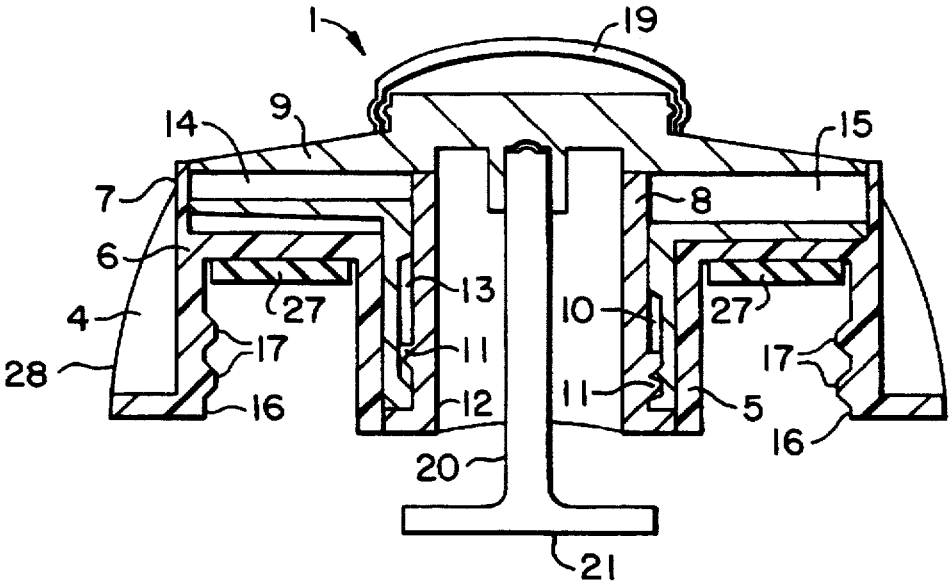
FIG. 1 illustrates a side elevational, cross-sectional view of the dual spout stopper of the present invention with its valve closed.
Figure 4:
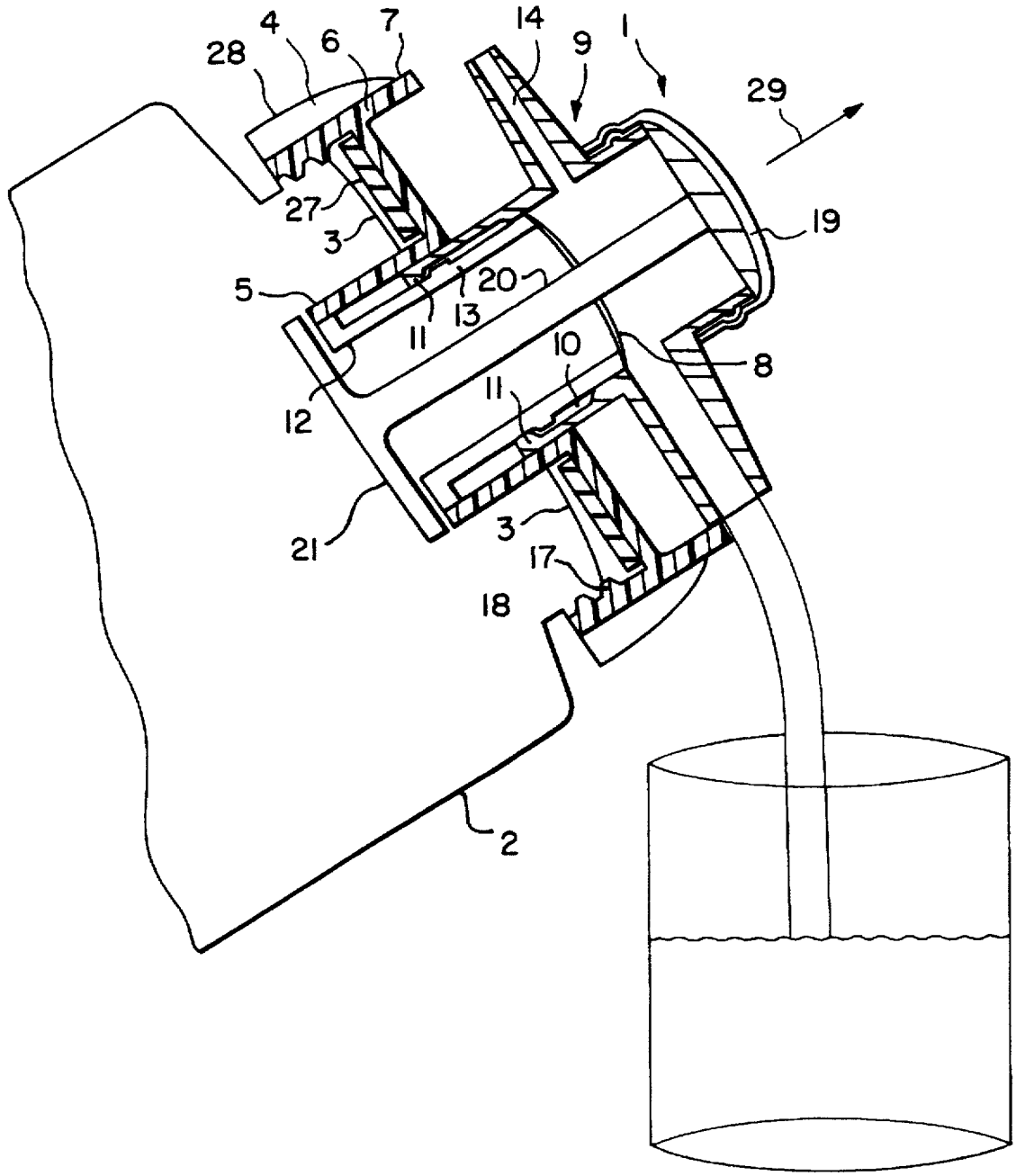
FIG. 4 illustrates a side elevational, cross-sectional view of the dual spout stopper of the present invention attached to a container with its valve open.

Referring to FIGS. 1, and 4, the fluid dispensing apparatus of the present invention, generally denoted as 1, is shown. In the preferred embodiment, the fluid dispensing apparatus of the present invention is sealingly engaged with a container 2 having a discharge opening 3. This sealing engagement is generally accomplished through the use an attachment portion 16 which is comprised of screw threads 17 integrally affixed to the interior diameter of the apparatus, whereby these screw threads 17 cooperatively attach in sealing relation to screw threads 18 mounted on the exterior diameter of the neck of the container 2. The attachment portion 16 is engaged and disengaged with the container 2 with the aid of a plurality of ovular indentations 28 integrally molded to the exterior diameter of the cylindrical skirt 4 and a cylindrical shield 7. These ovular indentations 28 are approximately the same width and diameter of the human finger, which allows the user to better grip the attachment portion of the present invention. The seal between the container 2 and the attachment portion 16 is enhanced through the use of an annular gasket 27 constructed of elastomeric material affixed to the underside of the circular annular plate 6.

The present invention is structurally comprised of a cylindrical skirt 4 which sealingly engageable with the discharge opening 3 of the container 2. An internal tubular sleeve 5, concentric with the cylindrical skirt 4, is integrally attached perpendicular to, and supported by, a circular annular plate 6. The circular annular plate 6 is, in turn, integrally attached perpendicular to the cylindrical skirt 4 and a cylindrical shield 7. The cylindrical shield 7 is concentric with the cylindrical skirt 4 and is integrally attached to the circular annular plate 6, as well as the cylindrical skirt 4. The cylindrical shield 7 extending upward perpendicular to the cylindrical skirt 4.

The fluid dispensing apparatus of the present invention is also comprised of a manually actuatable cylindrical valve assembly 8 comprising a telescoping dual spout assembly 9 and the internal tubular sleeve 5 in cooperative arrangement, wherein the telescoping dual spout assembly 9 is a component of the apparatus and moves axially and rotationally within said internal tubular sleeve 5, through a channel 10, to open and close said actuatable cylindrical valve. Such opening and closure is regulated by the cooperative movement of notches 11, which are integrally molded into the external diameter of the lower portion of a cylindrical valve chamber 12. The notches 11 move withing grooves 13, which are molded into the interior diameter of the cylindrical portion of the telescoping dual spout assembly 9.

Figure 2:
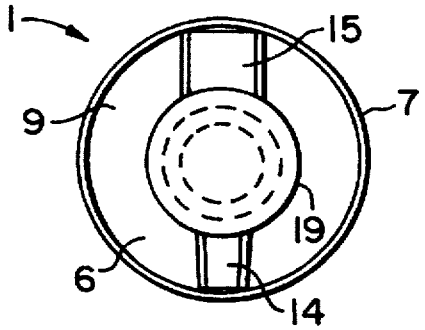
FIG. 2 illustrates a plan view of the dual spout stopper of the present invention.

The telescoping dual spout assembly 9 is, in turn, comprised of two separate flow chambers 14 and 15, which are integrally attached to the cylindrical valve chamber 12. As can be seen in FIG. 2, in the preferred embodiment the two separate flow chambers 14 and 15 are radially disposed 180 degrees apart about the cylindrical valve chamber. Referring now to FIGS. 1 and 4, the fluid dispensing apparatus of the present invention may have two separate flow chambers 14 and 15, with different diameters. For example, flow chamber 14 may have a narrower diameter than that of flow chamber 15. Other embodiments of the present invention (not shown) may have two separate flow chambers 14 and 15 with different shapes. For example, flow chamber 14 may be cylindrical, while flow chamber 15 may be the shape of a square, rectangle or other parallelogram.

Figure 3:
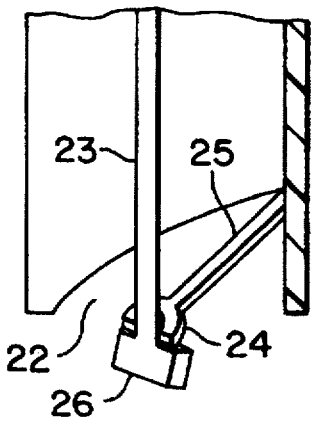
FIG. 3 illustrates a truncated cross-sectional view of an embodiment of the post and stay assembly of the present invention.

A cover plate 19 is attached to the telescoping dual spout assembly 9. A post unit 20 is attached perpendicular to the cover plate 19 and its length extends below the cylindrical internal tubular sleeve 5 and terminates with a second rod 21 integrally attached perpendicular to post unit 20, to form a "T" shaped assembly. As can be seen from FIG. 3, a second embodiment of the post unit 22 takes the form of a rod 23 attached perpendicularly at one end to the cover plate (not shown) and which extends axially therefrom through the eyelet 24 of a stay 25 and terminates with a plug 26 integrally attached to the rod 23. The stay 25 that is employed is affixed to the interior wall of the internal tubular sleeve 5 and extends horizontally across the opening of the sleeve 5 above the plug 26. The eyelet 24 is generally disposed about the midpoint of the stay 25. The diameter of the eyelet 24 is sufficient to allow the rod to freely move axially therethrough and where the width of the plug 26 in relation to that of the eyelet 24 will not allow the plug to pass through.

The structure of the fluid dispensing apparatus described above allows it to be easily opened and closed during use. Referring now to FIG. 4, under normal operating conditions, an axial force, depicted by arrow 29, is applied to the dual spout assembly 9. This causes the dual spout assembly 9 to move axially in relation to the internal tubular sleeve 5, whereby the notches 11 integrally molded into the internal tubular sleeve 5 move axially within the channels 10 that are integrally molded into the lower cylindrical portion of the dual spout assembly 9. This axial movement occurs until the notches 11 come in contact with the lower boundary of the channel 10, at which time axial movement ceases. At this point, axial movement of the dual spout assembly 9 is also retarded by the contact made by the perpendicular member 21 of the post unit 20 with the bottom of the internal tubular sleeve 5. In this position, the manually actuatable cylindrical valve assembly 8 is in the open position and the top of the cylindrical valve assembly 8 is below the openings of either of the two separate flow chambers 14 and 15. The fluid in container 2 is thus able to freely flow out of the cylindrical valve assembly 8 and into either of the flow chambers 14 or 15 chosen by the user, as demonstrated in FIG. 4. The manually actuatable cylindrical valve assembly 8 is closed by applying an opposite force to the dual spout assembly 9, which causes the dual spout assembly to move downward in relation to the internal tubular sleeve 5, until the top of the cylindrical valve assembly 8 is completely obscuring the openings of both of the two separate flow chambers 14 and 15, which are now cradled by the cylindrical shield 7 and are resting flush with the top of the circular annular plate 6. With the device oriented in this way, no fluid is permitted to flow from container 2.

What is claimed is:

1. A fluid dispensing apparatus of a container, said container having a discharge opening comprising:

a cylindrical skirt being sealingly engageable with the discharge opening of the container;

an internal tubular sleeve being concentric with said cylindrical skirt and integrally attached perpendicular to and supported by a circular annular plate which is in turn integrally attached perpendicular to said cylindrical skirt and a cylindrical shield;

said cylindrical shield being concentric with said cylindrical skirt and integrally attached to said circular annular plate and said cylindrical skirt and extending upward perpendicular thereto;

a manually actuatable cylindrical valve assembly comprising a telescoping dual spout assembly and said internal tubular sleeve in cooperative arrangement, wherein said telescoping dual spout assembly is a component of the apparatus and moves axially and rotationally within said internal tubular sleeve to open and close said actuatable cylindrical valve;

said telescoping dual spout assembly comprising two separate flow chambers integrally attached to a cylindrical valve chamber;

a cover attached to said manually telescoping dual spout assembly; and a post attached perpendicular to said cover and an annular gasket constructed of elastomeric material affixed to the underside of said circular annular plate.

2. The fluid dispensing apparatus as claimed in claim 1 wherein said attachment portion further comprises screw threads integrally affixed to the interior diameter of the apparatus, said screw threads cooperatively attaching in sealing relation to threads mounted on the exterior diameter of the neck of the container.

3. The fluid dispensing apparatus as claimed in claim 1 wherein said two separate flow chambers are radially disposed 180 degrees apart about the cylindrical valve chamber.

4. The fluid dispensing apparatus as claimed in claim 1 wherein said two separate flow chambers comprise a first separate flow chamber having a first diameter and a second separate flow chamber having a second diameter.

5. The fluid dispensing apparatus as claimed in claim 1 wherein said two separate flow chambers are of different shapes.

6. The fluid dispensing apparatus as claimed in claim 1 wherein said post is constructed of an elongated rod attached at one end to said cover and extending axially therefrom, terminating with a second rod integrally attached perpendicular thereto and extending below said internal tubular sleeve.

7. The fluid dispensing apparatus as claimed in claim 1 wherein said post comprises an assembly of a rod attached at one end to said cover and extending axially therefrom through a stay and terminating with a plug integrally attached to said rod below said stay;

said stay being affixed to the interior wall of the internal tubular sleeve above and extending horizontally across the opening thereof;

said stay further comprising an eyelet about its midpoint whose diameter allows said rod to freely move axially therethrough and where the width of said plug in relation to that of said eyelet will not allow said plug to pass through said eyelet.

8. The fluid dispensing apparatus as claimed in claim 1 wherein the exterior diameter of said cylindrical skirt and said cylindrical shield are comprised of a plurality of ovular indentations.

* * * * *